United States Patent [19]

Whorton, III et al.

[11] 4,355,735

[45] Oct. 26, 1982

[54] VALVING MECHANISM FOR BEVERAGE DISPENSING DEVICE

[75] Inventors: Robert B. Whorton, III, Spartanburg, S.C.; Samuel C. Crosby, Jr., Decatur, Ga.

[73] Assignee: Tannetics, Inc., Erie, Pa.

[21] Appl. No.: 168,053

[22] Filed: Jul. 14, 1980

[51] Int. Cl.[3] ..... B67D 1/04; B67D 5/54

[52] U.S. Cl. ..... 222/80; 222/153; 222/325; 222/397

[58] Field of Search ..... 222/129.1, 153, 325, 222/397, 80, 82

[56] References Cited

U.S. PATENT DOCUMENTS

| | | | |
|---|---|---|---|
| 3,292,822 | 12/1966 | Crowder et al. | 222/129.1 |
| 3,424,346 | 1/1969 | Fruehling | 222/86 X |
| 3,953,550 | 4/1976 | Gilbey | 222/397 X |

*Primary Examiner*—Robert J. Spar
*Assistant Examiner*—Frederick R. Handren

[57] ABSTRACT

A beverage dispensing device for dispensing carbonated drinks that are mixed from a solution of carbonated water and syrup. The device includes a syrup package, a source of carbonated water, and a mixing head connected to the source of carbonated water and to said syrup package for mixing a measured amount of the carbonated water with the syrup for producing carbonated drinks. The syrup package is carried in a receptacle and is coupled to a source of pressurized gas. A valve having a valve actuator positioned thereon is interposed between the source of pressurized gas and the coupling device with the valve actuator obstructing the removal of the package when in a first position and when in a second position venting the syrup package prior to permitting removal thereof.

2 Claims, 4 Drawing Figures

VALVING MECHANISM FOR BEVERAGE DISPENSING DEVICE

BACKGROUND OF THE INVENTION

Heretofore, carbonated drinks for home consumption have normally been purchased in bottles after carbonated water and syrup have been mixed in a large tank and the mixture inserted in the bottles. This procedure of supplying drinks for consumption is quite expensive since the majority of the carbonated drinks is water. In an attempt to overcome this problem, an in-home beverage dispensing device such as disclosed in application Ser. No. 06/054,304 filed on July 2, 1979, has been developed. In this particular device, syrup cartridges are placed in a receptacle and upon rotating are impaled upon piercing pins. One piercing pin is for supplying carbon dioxide to the syrup package for pressurizing the package in order to aid in dispensing the syrup from the package through the other piercing pin for being mixed at a mixing head.

One problem with such a device is that if the syrup package is removed from the piercing device while the package is still pressurized, syrup is subject to be expelled in and around the beverage dispensing machine.

SUMMARY OF THE INVENTION

The present invention relates to a valving mechanism for use with a beverage dispensing device. The beverage dispensing device is provided for dispensing carbonated drinks that are mixed from a solution of carbonated water and syrup. The device includes a syrup package, a source of carbonated water, and a mixing head connected to the source of carbonated water and to the syrup package for mixing a measured amount of carbonated water with the syrup producing a carbonated drink. A valve means is interposed between a source of pressurized gas and a coupling device which connects the pressurized gas to the interior of the syrup package. The valve means has an actuator that extends over the top of the syrup package when the syrup package is positioned in a receptacle so as to prevent the package from being removed from the receptacle and the coupling devices when the syrup package is pressurized. When the valve actuator means is rotated, it cuts off the source of pressurized gas from the coupling device and also vents the syrup package to the atmosphere.

Accordingly, it is an important object of the present invention to provide a valve actuator means for use in a beverage dispensing device which ensures that packages of syrup provided therein are vented prior to removal.

Still another important object of the present invention is to provide a relatively simple and substantially foolproof valve system for turning on and removing pressurized gas from a syrup package.

These and other objects and advantages of the invention will become apparent upon reference to the following specification, attendant claims and drawings.

DESCRIPTION OF A PREFERRED EMBODIMENT

Figure 1:
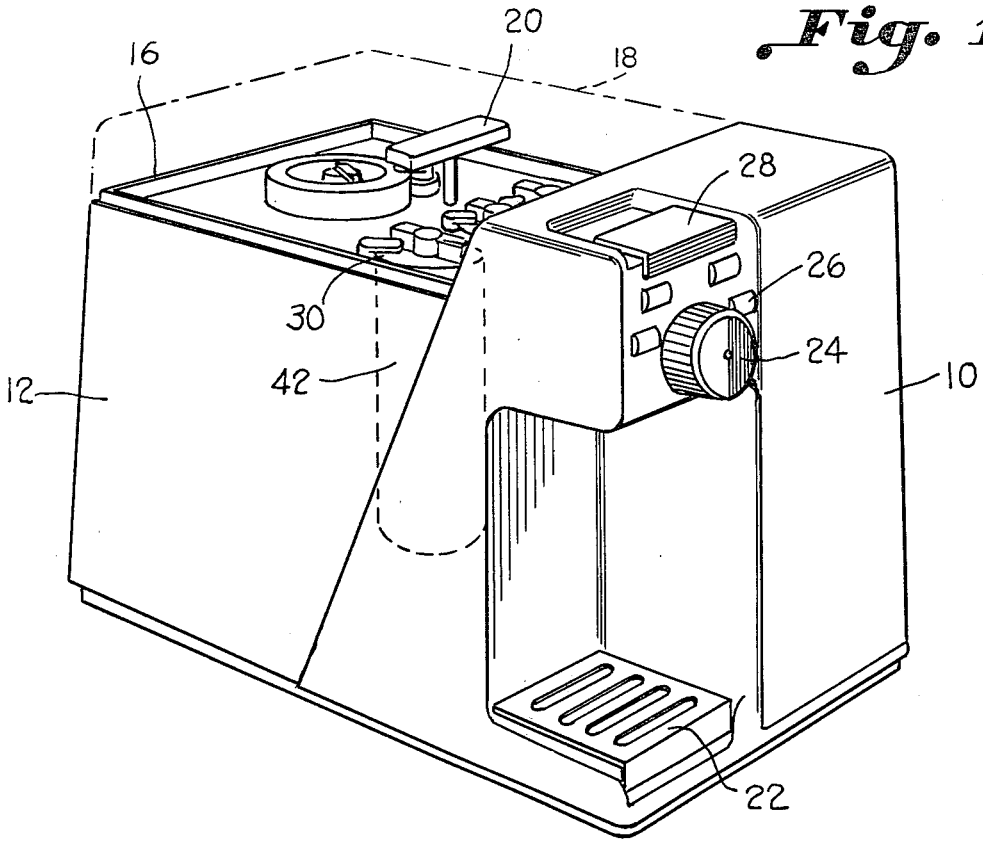
FIG. 1 is a perspective view with parts removed for purposes of clarity illustrating a beverage dispensing device upon which a valving mechanism constructed in accordance with the present invention is utilized.
Figure 2:
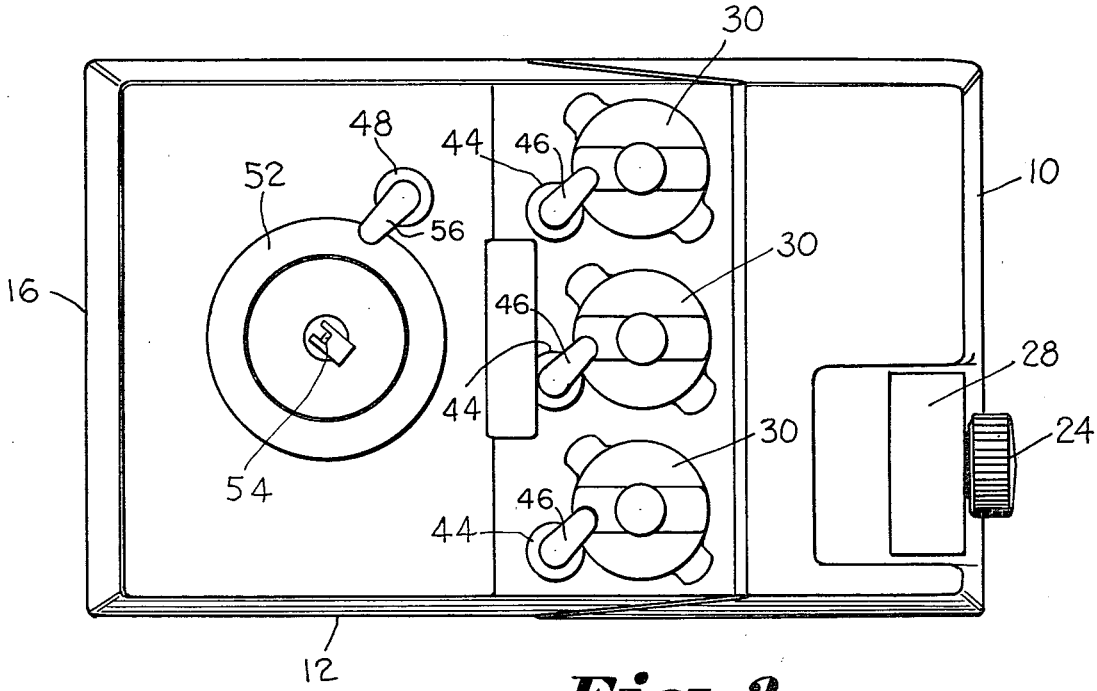
FIG. 2 is a plan view of the beverage dispensing device shown in FIG. 1.

Referring to FIG. 1, there is illustrated a beverage dispensing device that is suitable for in-home use. The dispenser includes a front wall 10 joined by side walls 12 and 14 and a rear wall 16. A cover 18 shown in phantom lines extends over the rear top portion of the dispenser and has a slotted hole provided therein so as to provide access to a handle 20 which is used in lifting the machine.

A recess is provided adjacent one front corner of the dispenser in which cups and the like are positioned on top of a drip tray 22 for being filled with a carbonated drink. A mixing valve 24 extends out the front of the machine and is provided to select one of three different flavors by merely rotating the knob 24 to one of the particular selection locations 26. A pull handle 28 is provided adjacent the top front of the dispenser for activating the mixing valve causing a mixture of syrup and carbonated water to be dispensed in the cup positioned below the mixing head.

The syrup for the three different flavors that can be dispensed is carried within syrup packages 30 each of which is positioned in a receptacle. The syrup packages correspond in shape to the syrup package shown in our copending application Ser. No. 06/054,304 filed on July 2, 1979. Each of the syrup packages 30 as shown in FIG. 3 has outwardly projecting lobes 32 and 34 provided thereon into which piercing pins extend when the package is pushed down into the receptacle.

Figures 3, 4:
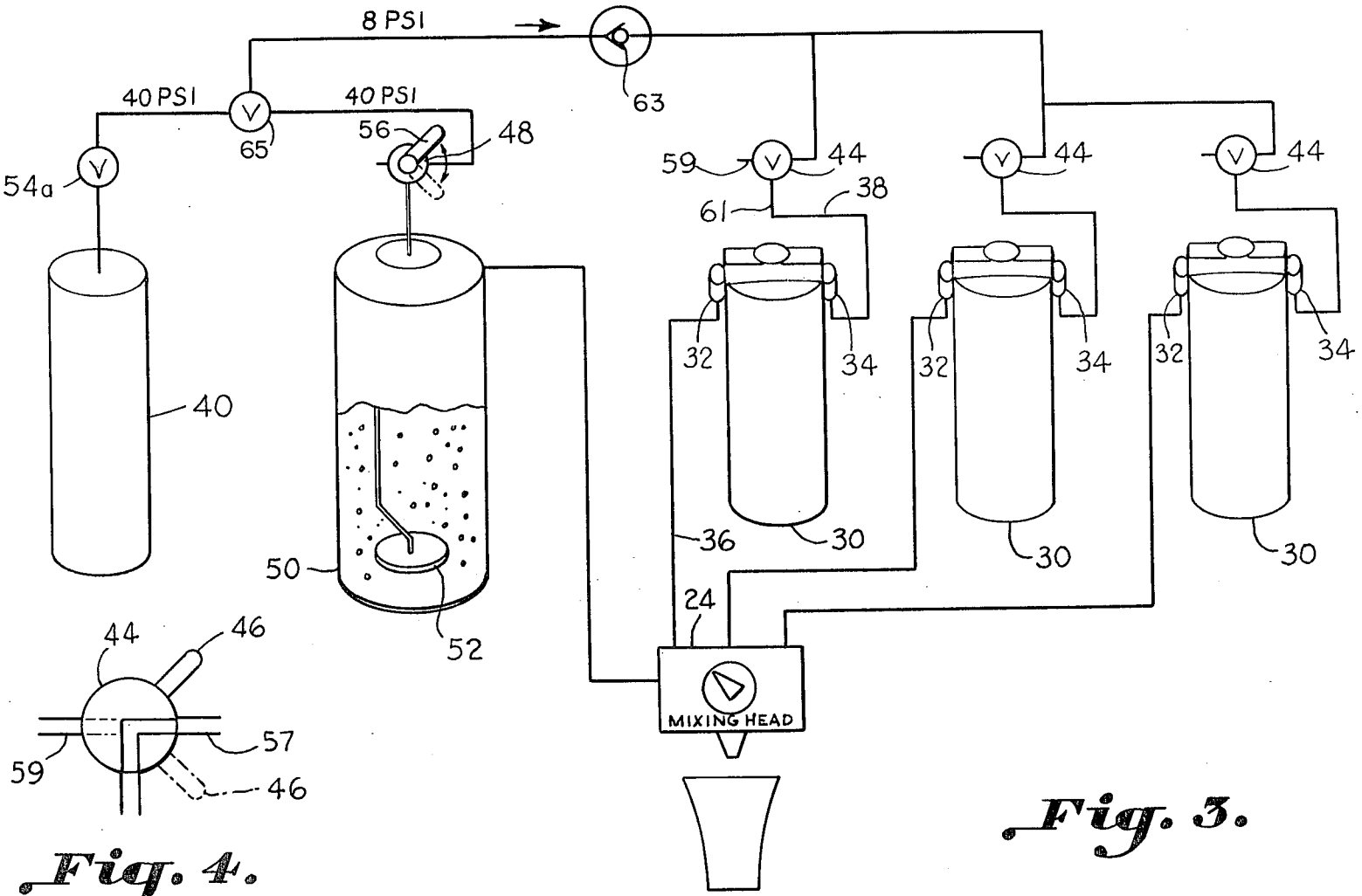
FIG. 3 is a flow diagram for the pressurized gas and syrup utilized in the dispensing device.
FIG. 4 is a schematic showing of a syrup package valve.

As shown in FIG. 3, the lobe 32 into which the piercing pin extends is connected by means of a tube 36 to the mixing head 24. The lobe 34, in turn, is connected by tubular means 38 to a source of pressurized gas 40. As a result, when the syrup cartridges are positioned in the receptacles, they are pressurized by carbon dioxide gas from the pressurized tank 40 causing the syrup to be dispensed from the syrup package to the mixing head.

It is important that prior to removing the packages 30 from the receptacle 42 shown in dotted lines in FIG. 1, the piercing pin associated with lobe 34 be cut off from the pressurized source of gas 40. It is also important that the packages 30 be vented so that the syrup will not be expelled from the package as it is being removed.

In order to ensure that the source of pressurized gas 40 is separated from the syrup package and the syrup package is vented, a valve 44 is physically mounted on a surface 45 adjacent the top of the receptacle 42. The valve 44 has a valve actuating arm 46 which extends over the top of the syrup package when the valve is opened. As a result, the syrup package cannot be physically removed from the receptacle by lifting vertically upwardly. Prior to removing the package 30 from the receptacle, it is necessary that the valve actuator arm 46 be rotated counterclockwise to the position shown in broken lines.

When the valve 44 is in this position, it disconnects the piercing pin associated with lobe 34 from the source of pressurized gas 40 and it also allows the package 30 to be vented to the atmosphere.

A similar valve 48 is associated with a carbonating tank 50 for the dispenser. Positioned on top of the carbonating tank 50 is a removable cap 52. The cap 52 has a vent valve 54 provided thereon. However, the valve 48 also ensures venting of the carbonated tank 50 prior to removing the cap 52. Before the cap 52 can be removed, the actuator arm 56 must be rotated ninety degrees (90°). In this position, the valve actuating arm 56 vents the carbonated tank 50 and shuts off the flow of carbon dioxide gas to the tank. As shown in FIG. 3, the carbonating tank 50 has a diffuser 52 provided in the bottom which causes the carbon dioxide gas to bubble up through the water provided in the tank for carbonizing the water. The tank 50 may be any suitable carbonating tank such as disclosed in U.S. Pat. Nos. 3,746,323 and 3,578,295.

Referring in more detail to FIG. 3 of the drawing, normally the pressure of the carbon dioxide within tank 40 is between 500 and 1300 p.s.i. As the carbon dioxide leaves the tank 40 it passes through a regulating valve 54*a* which reduces the pressure down to 40 p.s.i. as shown in the drawing. The 40 lbs. of pressure is then fed through another regulating valve 65 which allows 40 p.s.i. to pass through to the valve 48 into the carbonated tank 50. On its other output, it reduces the pressure to 8 p.s.i. as shown which is fed through a check valve 63. This 8 lbs. of pressure is fed to the syrup package 30 for pressurizing the syrup packages.

As shown in FIG. 4, when the actuator arm 46 is shifted from the full line position to the dotted line position, connection is provided between tube 61 which is connected to the syrup package and the vent tube 59 for venting the syrup package prior to removal of the syrup package from the receptacle. As previously mentioned, when the actuator arm 46 is in the full line position, connection is provided between pressure line 57 and line 61 for pressurizing the syrup package with carbon dioxide.

While a preferred embodiment of the invention has been described using specific terms, such description is for illustrative purposes only, and it is to be understood that changes and variations may be made without departing from the spirit or scope of the following claims.

What is claimed is:

1. A beverage dispensing device for dispensing carbonated drinks that are mixed from a solution of carbonated water and syrup, said device including a disposable syrup package, a source of carbonated water, a mixing head connected to said source of carbonated water and to said syrup package for mixing a measured amount of said carbonated water with said syrup producing a carbonated drink, said syrup package being carried in a receptacle, the improvement comprising:

a source of pressurized gas;

a piercing device impaling said syrup package and connecting said pressurized gas to the interior of said syrup package;

valve means interposed between said source of pressurized gas and said piercing device;

valve actuator means causing said valve to provide communication between said source of pressurized gas and said syrup package when in a first position and venting said syrup package back through said valve when in a second position;

said valve actuator means extending over a top of said package obstructing the removal of said piercing device from said syrup package and removal of said syrup package from said receptacle when in said first position for ensuring that said syrup package is vented back through said valve prior to removal of said piercing device from said package and prior to removal of said package from said receptacle in order to prevent syrup from being expelled from said package upon being removed from said piercing device.

2. The beverage dispensing device as set forth in claim 1 further comprising:

said valve actuator means including a rotatable arm capable of being manually rotated between said first and second positions.

* * * * *